US005860290A

United States Patent [19]

Gregory

[11] Patent Number: 5,860,290

[45] Date of Patent: Jan. 19, 1999

[54] REFRIGERATION SYSTEM WITH IMPROVED HEAT EXCHANGER EFFICIENCY

[75] Inventor: Charles Gregory, Burlington, Canada

[73] Assignee: Super S.E.E.R. Systems Inc., Burlington, Canada

[21] Appl. No.: 5,582

[22] Filed: Jan. 12, 1998

[51] Int. Cl.[6] ..... A47F 3/04

[52] U.S. Cl. ..... 62/256; 62/513

[58] Field of Search ..... 62/246, 256, 513, 62/113

[56] References Cited

U.S. PATENT DOCUMENTS

| | | | |
|---|---|---|---|
| 1,930,296 | 10/1933 | Warneke | 62/513 |
| 2,036,756 | 4/1936 | Hull | 62/513 |
| 2,226,797 | 12/1940 | Andersson | 62/513 |
| 2,520,045 | 8/1950 | McGrath | 62/513 |
| 3,394,563 | 7/1968 | Schwing | 62/513 |

*Primary Examiner*—William E. Tapolcai
*Attorney, Agent, or Firm*—Rogers & Scott

[57] ABSTRACT

A refrigeration system has an evaporator compartment containing a refrigeration evaporator and a refrigeration heat exchanger, a liquid line for conveying liquid refrigerant from a compressor through the heat exchanger to the evaporator, and a suction line for conveying vaporized refrigerant from the evaporator through the heat exchanger in heat exchange relationship with the liquid refrigerant flowing therethrough to a compressor. The refrigeration system also has a compartment to be cooled, and an air flow passage associated with the compartment for cooling thereof, the air flow passage passing through the evaporator compartment whereby the air flow passes over the liquid line and evaporator, the liquid line being thermally insulated from the air passing thereover. The refrigeration system may be used in a refrigerated merchandising display case.

8 Claims, 3 Drawing Sheets

REFRIGERATION SYSTEM WITH IMPROVED HEAT EXCHANGER EFFICIENCY

BACKGROUND OF THE INVENTION

Conventional refrigeration systems have a compressor which pumps refrigerant vapour to condense to liquid refrigerant. The liquid refrigerant flows through the liquid line into a receiver tank where sufficient liquid refrigerant is stored to maintain a liquid seal for the liquid line through which the liquid refrigerant flows to a thermostatic expansion (TX) valve which controls the flow of liquid refrigerant to an evaporator coil, where pressure is reduced to cause the liquid refrigerant to vaporize with consequent absorption of heat. The refrigerant vapour flows through a suction line to the compressor. This is a dynamic closed loop, with a change in state of the refrigerant from vapour to liquid emitting heat, then from liquid to vapour absorbing heat.

When the liquid refrigerant passes through the TX valve and vaporizes with consequent heat absorption in the evaporator coil, the temperature of the liquid refrigerant has first to be lowered to the vaporizing temperature, thereby causing a loss in the cooling efficiency of the refrigeration system. The higher the liquid refrigerant temperature the greater the loss of efficiency. To assist in minimizing this problem, it is well known to use a liquid line to suction line heat exchanger in which the temperature of the liquid in the liquid line is lowered by the gas at lower temperature in the suction line.

In refrigerated merchandising cases in supermarkets, it is conventional to use heat exchangers which cool the liquid refrigerant by close thermal contact with the colder refrigerant suction gas. In such merchandising cases, the reduction of liquid refrigerant temperature has been believed to increase the efficiency of the refrigeration system by at least about 8%, thereby producing worthwhile savings in operating costs.

As part of a general investigation into possible ways of still further increasing efficiency of refrigeration systems in refrigerated merchandising cases in supermarkets, the applicant investigated the temperature difference between the temperature of the liquid refrigerant in the liquid line entering the heat exchanger and the temperature of the liquid refrigerant in the liquid line leaving the heat exchanger in a typical supermarket installation. It was expected that this would be a significant temperature difference, with the magnitude of the temperature difference indicating the increase in efficiency obtained by use of the heat exchanger. Applicant was surprised to find that, contrary to expectations, there was no meaningful temperature difference, with there consequently being virtually no benefit obtained by use of the heat exchanger. This finding is probably true for tens of thousands of heat exchangers currently in use in refrigerated display cases in supermarkets.

SUMMARY OF THE INVENTION

One of the reasons applicant investigated liquid line temperatures in refrigerated merchandising cases in supermarkets was to attempt to ascertain why a TX valve, when installed with a superheat sensor as described in applicant's U.S. Pat. No. 5,052,190, the contents of which are hereby incorporated herein by reference, operated with a very precise and constant low superheat in applicant's research test merchandising cases, but did not perform as well in actual field conditions in supermarkets.

Further tests on refrigerated merchandising cases in supermarkets showed that changes in liquid line temperature of up to about 25° F. (−4° C.) occurred approximately every five minutes. Such changes, which due to changes in refrigerant density and net refrigerating effect, vary the capacity of the TX valve by up to about 25%. In applicant's research test merchandising cases, there were virtually no such temperature swings. Applicant realized that the research test merchandising cases had a relatively very short liquid line compared to conventional refrigerated merchandising cases in supermarkets. In such conventional cases, it is standard practice to run an oversized copper liquid line along the length of the case, resulting in low liquid velocity in the liquid line. Applicant has consequently realized that, in the conventional refrigerated display cases in supermarkets, air blown over the copper liquid line sub-cools the line, and that this results in the temperature swings mentioned above.

Thus, the slow moving liquid refrigerant in the liquid line is sub-cooled by the refrigerated air before entering the heat exchanger. This results in virtually no saving because the heat content of the liquid in the liquid line is transferred to the case air and has to be removed by the evaporator. When superheat control is provided, the constantly changing capacity of the TX valve results in fluctuating superheat control.

Applicant then realized that the conventional thinking that the liquid line should not be insulated so as to obtain sub-cooling of the liquid in the liquid line by the case air passing thereover was the cause of the problem.

The present invention is therefore based on the discovery, as described above, that the lack of heat exchanger efficiency in refrigerated merchandising cases in supermarkets was due to the conventional practice of not insulating the liquid line in order to supposedly improve the efficiency of the system.

According to the present invention therefore, the liquid in the liquid line is insulated from the case air passing thereover.

Accordingly the present invention provides a refrigeration system having an evaporator compartment containing a refrigeration evaporator and a refrigeration heat exchanger, a liquid line for conveying liquid refrigerant from a compressor through the heat exchanger to the evaporator, and a suction line for conveying vaporized refrigerant from the evaporator through the heat exchanger in heat exchange relationship with the liquid refrigerant flowing therethrough to a compressor, a compartment to be cooled, and an air flow passage associated with the compartment for cooling thereof, said air flow passage passing through the evaporator compartment whereby the air flow passes over the liquid line and evaporator, the liquid line being thermally insulated from the air passing thereover.

The liquid line may be of metal and be surrounded by heat insulating material. The heat insulating material may comprise cellular rubber-like material. Alternatively, the liquid line may be made of heat insulating material.

The present invention also provides a refrigerated merchandising display case having a merchandise compartment to be cooled, an air flow passage through which air is circulated within the case to cool the merchandise compartment, an evaporator compartment through which the air flow passage passes, a refrigeration evaporator and a refrigeration heat exchanger in the evaporator compartment, a liquid line conveying liquid refrigerant from a compressor through the heat exchanger to the evaporator, and a suction line for conveying vaporized refrigerant from the evaporator through the heat exchanger in heat exchange relationship with the liquid refrigerant flowing therethrough to a compressor, whereby air flow in the air flow passage passes over the heat exchanger and the evaporator, the liquid line being thermally insulated from the air flow passing thereover.

BRIEF DESCRIPTION OF THE DRAWINGS

One embodiment of the invention will now be described, by way of example, with reference to the accompanying drawings, of which.

DESCRIPTION OF PREFERRED EMBODIMENT

Figure 1:
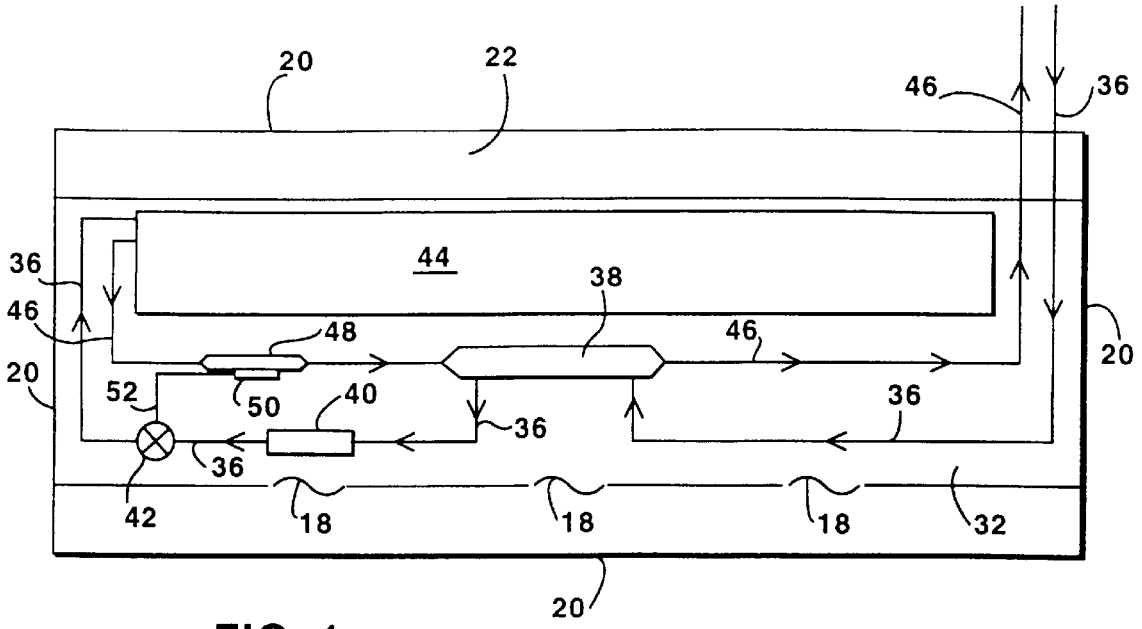
FIG. 1 is a diagrammatic plan view of the refrigeration components in the evaporator compartment in the base portion of a conventional supermarket refrigerated merchandising case.

Referring to the drawings, a supermarket refrigerated merchandising case has outer side walls 20, an outer bottom wall 22 and a top wall 24 which extends only a short distance laterally inwardly from the side walls 20 so as to provide an open top 26 for access by customers. The case also has inner metal side walls 28 and an inner metal bottom wall 30 which are spaced from the outer side walls 20 and outer bottom wall 22 respectively so as to provide an air flow passage 32 therebetween. At the top of the case, the air flow passage 32 communicates with the opened top 26. The inner side and bottom walls 28, 30 provide a merchandise receiving compartment 31 to which customers have access through the opened top 26.

The base portion of the case has an evaporator compartment 34 between the inner and outer bottom walls 30, 22. A liquid line from a condenser (not shown) passes into the evaporator compartment 34 to the outer shell of a heat exchanger 38, and then from the heat exchanger 38 through a filter 40 and TX valve 42 to a finned evaporator coil 44. A suction line 46 leaves the evaporator coil 44 and passes through a superheat sensor 48 and an inner shell of the heat exchanger 38 and leaves the evaporator compartment 32 for passage to a compressor (not shown). The TX valve 42 has a temperature sensor bulb 50 attached to the superheat sensor 48 and connected to the TX valve 42 by a line 52 to improve control of the TX valve 42 in known manner.

Figure 2:
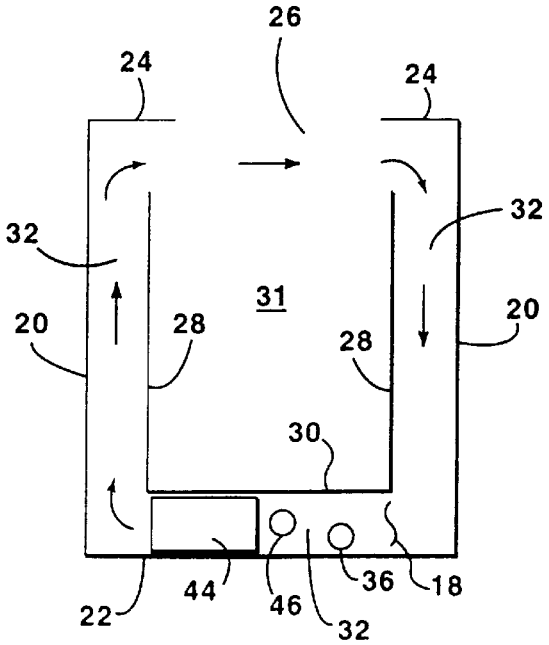
FIG. 2 is a diagrammatic side view of a conventional supermarket refrigeration merchandising case showing the air flow therein.

The evaporator compartment 32 also has a series of fans 18 which cause air to circulate along the passageway 32, i.e. down one side of the case, through the evaporator compartment 32 and up the other side of the case, as indicated by the arrows in FIG. 2, to cool the merchandise receiving compartment 31. As also shown by arrows, the air flow leaving the air passage 32 on one side of the case passes across the opened top 26 and into the air passage 32 on the other side of the case. The cool case air thus flows over the liquid line 36 and other components in the evaporator compartment 32.

Figure 3:
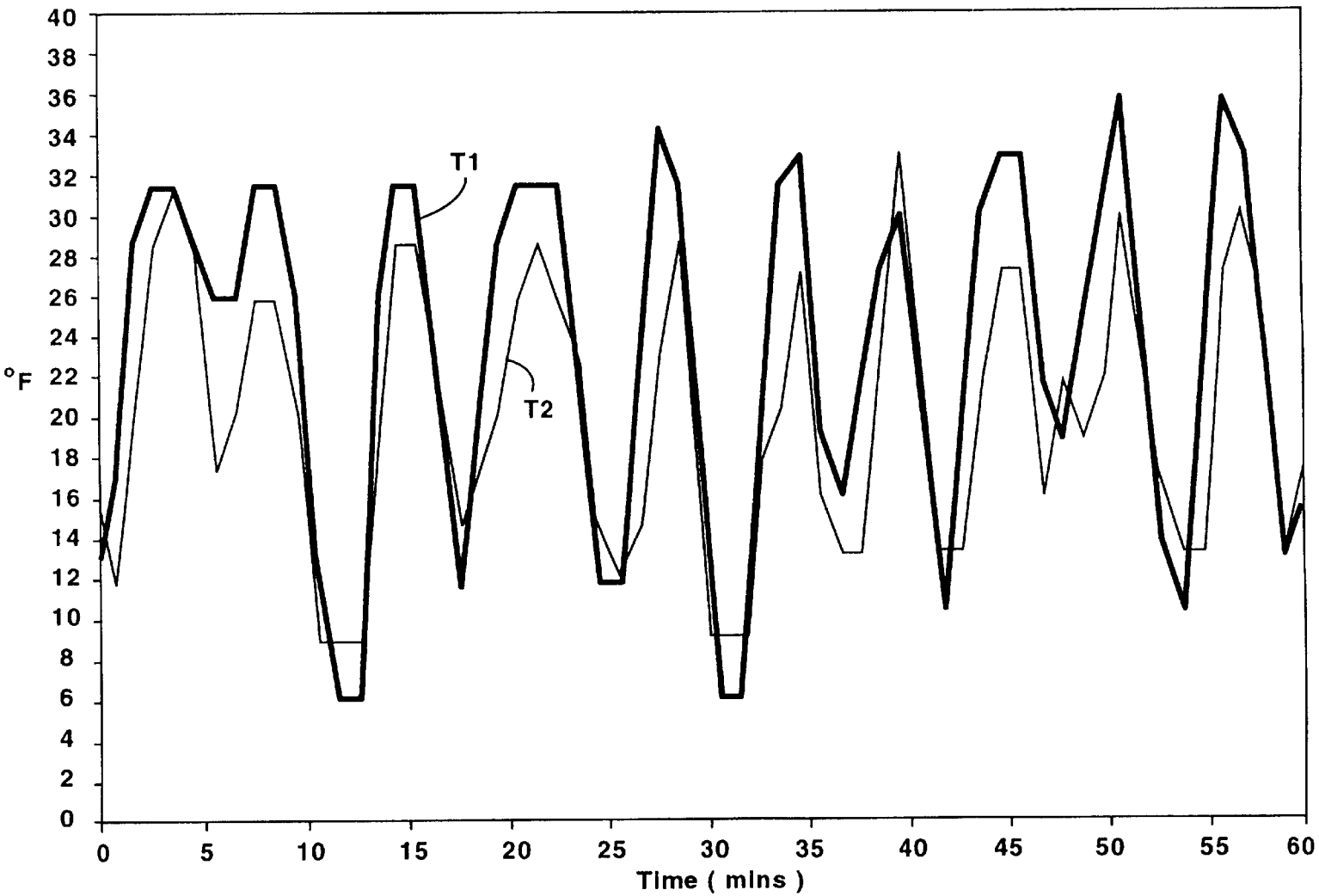
FIG. 3 is a graph showing the difference over a period of time between the liquid and the liquid line entering the heat exchanger and the liquid in the liquid line leaving the heat exchanger in a conventional refrigerated merchandising case in a supermarket.

As mentioned earlier, conventional refrigerated merchandising cases in supermarkets usually have an uninsulated copper liquid line 36. Measurements were made over a period of time on a supermarket insulation of the temperature of the liquid refrigerant in the liquid line 36 entering the heat exchanger 38 and the temperature of the liquid refrigerant in the liquid line 36 leaving the heat exchanger 38. The results are shown in FIG. 3, with the thicker line showing the inlet temperature T1 and the thinner line showing the exit temperature T2. Clearly, the difference between temperatures T1 and T2 at any given time are very small. In other words, the heat exchanger 38 is virtually ineffective.

Figure 4:
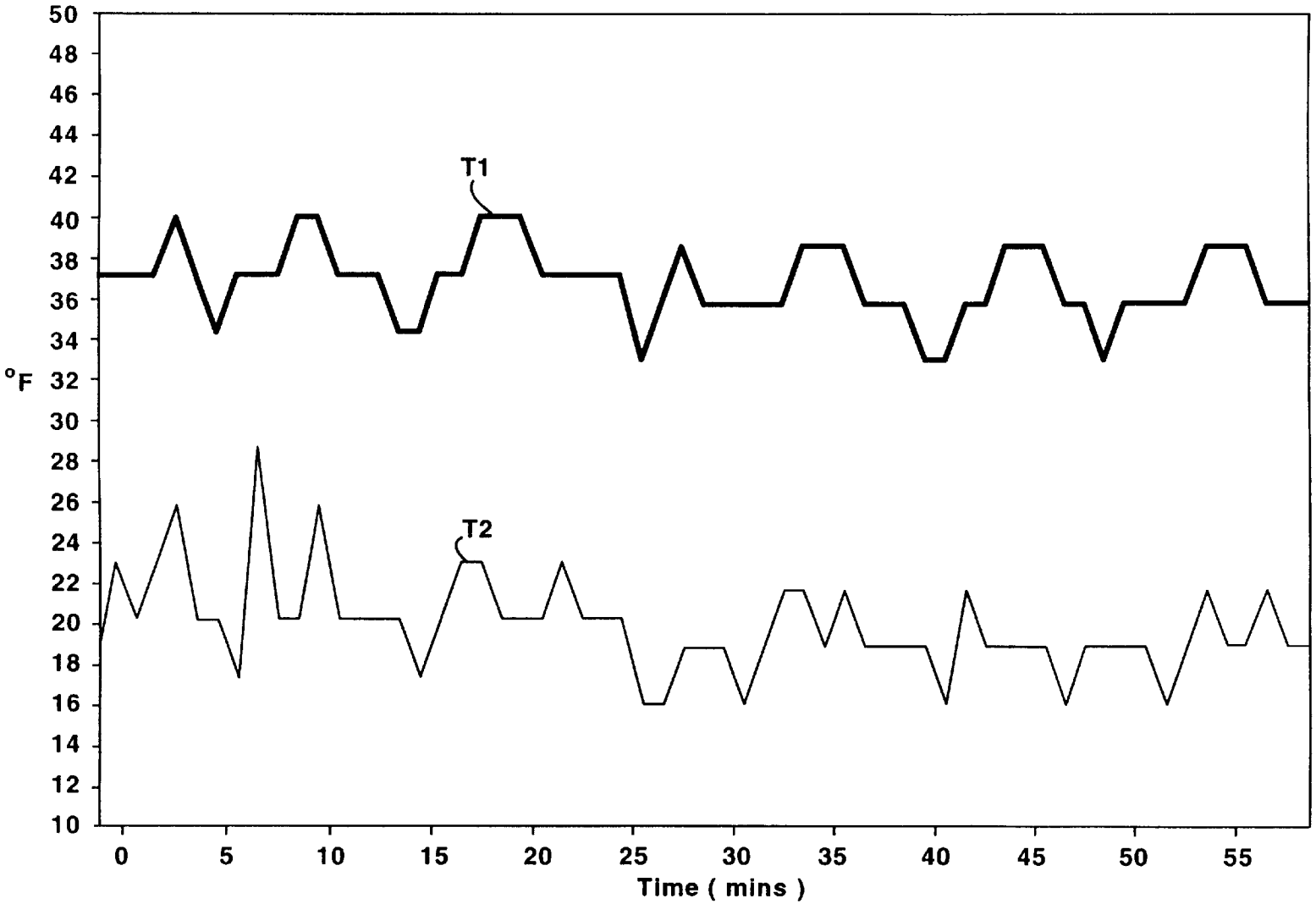
FIG. 4 is a similar graph showing the temperature difference over a similar period of time when the liquid in the liquid line has been insulated from the case air in accordance with the invention.

The liquid line 36 was then insulated in accordance with the invention. In this embodiment, the liquid line 36 was insulated with a cellular rubber-like material such as Rubatex or Armaflex (trademarks). The heat exchanger 38 and filter 40 were similarly insulated. The previously described measurements were repeated, and the results are shown in FIG. 4. The dramatic improvement, i.e. the marked difference between inlet and exit temperature T1 and T2 at any given time are self-evident. A very significant increase in heat exchanger efficiency has therefore been provided by the invention.

In the above described embodiment, a conventional copper liquid line was insulated by the application of insulating material. It will be readily apparent to a person skilled in the art that the liquid in the liquid line could also be insulated from the case air passing thereover by making the liquid line itself of suitable insulating material.

The present invention may advantageously be used with the improved refrigeration systems described and claimed in applicant's U.S. patent application Ser. No. 08/898,857 filed Jul. 25, 1997 and/or U.S. Pat. No. 5,706,665 issued Jan. 13, 1998, the contents of which are hereby incorporated herein by reference.

Other embodiments will also be readily apparent to a person skilled in the art, the scope of the invention being defined in the appended claims.

I claim:

1. A refrigeration system having:

an evaporator compartment containing a refrigeration evaporator and a refrigeration heat exchanger, a liquid line for conveying liquid refrigerant from a compressor through the heat exchanger to the evaporator, and a suction line for conveying vaporized refrigerant from the evaporator through the heat exchanger in heat exchange relationship with the liquid refrigerant flowing therethrough to a compressor, a compartment to be cooled, and an air flow passage associated with the compartment for cooling thereof, said air flow passage passing through the evaporator compartment whereby the air flow passes over the liquid line and evaporator, the liquid line being thermally insulated from the air passing thereover.

2. A refrigeration system according to claim 1 wherein the liquid line is of metal and is surrounded by heat insulating material.

3. A refrigeration system according to claim 2 wherein the heat insulating material comprises cellular rubber-like material.

4. A refrigeration system according to claim 1 wherein the liquid line is made of heat insulating material.

5. A refrigerated merchandising display case having:

a merchandise compartment to be cooled, an air flow passage through which air is circulated within the case to cool the merchandise compartment, an evaporator compartment through which the air flow passage passes, a refrigeration evaporator and a refrigeration heat exchanger in the evaporator compartment, a liquid line conveying liquid refrigerant from a compressor through the heat exchanger to the evaporator, and a suction line for conveying vaporized refrigerant from the evaporator through the heat exchanger in heat exchange relationship with the liquid refrigerant flowing therethrough to a compressor, whereby air flow in the air flow passage passes over the heat exchanger and the evaporator, the liquid line being thermally insulated from the air flow passing thereover.

6. A refrigerated merchandising display case according to claim 5 wherein the liquid line is of metal and surrounded by heat insulating material.

7. A refrigerated merchandising display case according to claim 6 wherein the heat insulating material comprises cellular rubber-like material.

8. A refrigerated merchandising display case according to claim 5 wherein the liquid line is of heat insulating material.

* * * * *